US009986612B2

(12) United States Patent
Murakami

(10) Patent No.: US 9,986,612 B2
(45) Date of Patent: May 29, 2018

(54) LIGHTING CONTROL DEVICE, LIGHTING SYSTEM, LIGHTING CONTROL METHOD

(71) Applicant: PANASONIC INTELLECTUAL PROPERTY MANAGEMENT CO., LTD., Osaka (JP)

(72) Inventor: Yoshinobu Murakami, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days. days.

(21) Appl. No.: 15/791,094

(22) Filed: Oct. 23, 2017

(65) Prior Publication Data

US 2018/0116024 A1 Apr. 26, 2018

(30) Foreign Application Priority Data

Oct. 26, 2016 (JP) ..... 2016-209772

(51) Int. Cl.
*H05B 37/02* (2006.01)
*H05B 33/08* (2006.01)
*H05B 41/392* (2006.01)

(52) U.S. Cl.
CPC ..... *H05B 33/0845* (2013.01); *H05B 33/0809* (2013.01); *H05B 41/3921* (2013.01)

(58) Field of Classification Search
CPC ..... H05B 33/0815; H05B 33/0818; H05B 41/2828; H05B 41/3921; H05B 41/3927; H05B 37/029; H05B 37/02; H05B 37/0254; H05B 33/0857; H05B 33/0863; H05B 33/0827; H05B 41/28; H05B 33/0803
See application file for complete search history.

(56) References Cited

U.S. PATENT DOCUMENTS 9,839,093 B1 * 12/2017 Blanchard ..... H05B 33/0884
2015/0108904 A1 * 4/2015 Chen ..... H03K 17/133 315/153

FOREIGN PATENT DOCUMENTS

JP 2013-235776 A 11/2013

* cited by examiner

*Primary Examiner* — Minh D A
(74) *Attorney, Agent, or Firm* — McDermott Will & Emery LLP

(57) ABSTRACT

The lighting control device includes a controller. The controller generates a second dimming signal corresponding to a measurement result of brightness of surroundings in the first mode and generates a second dimming signal corresponding to a first dimming signal in the second mode. The controller selects the first mode and start operating in the first mode when receiving the first dimming signal having a third duty cycle not falling within a range from a first duty cycle corresponding to an upper limit of the dimming level to a second duty cycle corresponding to a lower limit of the dimming level. The controller selects the second mode and start operating in the second mode when receiving the first dimming signal having a duty cycle falling within the range.

15 Claims, 4 Drawing Sheets

LIGHTING CONTROL DEVICE, LIGHTING SYSTEM, LIGHTING CONTROL METHOD

CROSS-REFERENCE TO RELATED APPLICATION

The present application is based upon and claims the benefit of priority of Japanese Patent Application No. 2016-209772, filed on Oct. 26, 2016, the entire contents of which are incorporated herein by reference.

TECHNICAL FIELD

The present disclosure relates to lighting control devices, lighting systems, and lighting control methods, and particularly to a lighting control device for dimming control of a lighting fixture, a lighting system including the lighting control device and a lighting fixture, and a lighting control method for dimming control of a lighting fixture.

BACKGROUND ART

Document 1 (JP 2013-235776A) discloses a lighting system including at least one lighting fixture, a dimmer for outputting a dimming signal, and a dimming signal conversion device for converting the dimming signal (duty signal) outputted from the dimmer into a phase control signal and outputting the phase control signal to the lighting fixture.

The dimmer includes a dimmer body with a rectangular box shape to be attached to a wall surface. The dimmer body is provided at its front face with a rotary manual control knob for selecting a dimming level of the lighting fixture. The manual control knob is provided to the dimmer body and is rotatable within a range of manual control positions including a manual control position corresponding to a lower limit value of the dimming level and a manual control position corresponding to an upper limit value of the dimming level. The dimmer generates a rectangular wave signal (duty signal) with a duty cycle corresponding to a manual control position of the manual control knob, and outputs to a dimming signal line the dimming signal being the rectangular wave signal.

Note that, in such lighting systems, there are demands to realize dimming control of changing the dimming level of the lighting fixture automatically depending on brightness of surroundings, in addition to dimming control responding to human manual control, for example. However, it is considered difficult to satisfy the above demands by configurations of the lighting system and the dimming signal conversion device (lighting control device) disclosed in document 1.

SUMMARY

An object according to the present disclosure would be to propose a lighting control device, a lighting system, and a lighting control method which can increase types of dimming control and improve usability.

A lighting control device according to one aspect of the present disclosure includes: an input circuit configured to receive from outside a first dimming signal having a duty cycle corresponding to a dimming level designating brightness of a lighting fixture; and an output circuit configured to output a second dimming signal to the lighting fixture. The lighting control device further includes: a detector configured to measure brightness of surroundings; and a controller configured to select one operation mode from two operation modes including a first mode and a second mode, and operate in a selected operation mode. The first dimming signal has a duty cycle falling within a range from a first duty cycle corresponding to an upper limit of the dimming level of the lighting fixture to a second duty cycle corresponding to a lower limit of the dimming level of the lighting fixture. The controller is configured to, while operating in the first mode, generate a second dimming signal corresponding to a measurement result of the detector. The controller is configured to, while operating in the second mode, generate a second dimming signal corresponding to the first dimming signal. The controller is configured to select the first mode and start operating in the first mode when the input circuit receives the first dimming signal having a third duty cycle not falling within the range while operating in the second mode. The controller is configured to select the second mode and start operating in the second mode when the input circuit receives the first dimming signal having a duty cycle falling within the range while operating in the first mode.

A lighting system according to another aspect of the present disclosure includes: the lighting control device; and a manual control device configured to output the first dimming signal having a duty cycle corresponding to the dimming level to the input circuit of the lighting control device. The manual control device includes: a manual control interface for allowing manual control by hand; and a signal output circuit configured to output the first dimming signal having a duty cycle corresponding to manual control of the manual control interface.

A lighting system according to another aspect of the present disclosure includes: the lighting control device; and at least one lighting fixture. The at least one lighting fixture is configured to, when receiving the second dimming signal outputted from the output circuit of the lighting control device, allow light output thereof to correspond to a dimming level indicated by the second dimming signal received.

A lighting control method according to another aspect of the present disclosure includes: selecting one control method from two control methods including a first control method and a second control method; and performing a selected control method to achieve dimming control of at least one lighting fixture. The first control method is a control method of generating a second dimming signal corresponding to a measurement result of brightness of surroundings. The second control method is a control method of generating a second dimming signal corresponding to a first dimming signal having a duty cycle corresponding to a dimming level designating brightness of the at least one lighting fixture. The first control method is selected and performed when the first dimming signal having a third duty cycle not falling within a range from a first duty cycle corresponding to an upper limit of the dimming level to a second duty cycle corresponding to a lower limit of the dimming level is inputted while the second control method is performed. The second control method is selected and performed when the first dimming signal having a duty cycle falling within the range is inputted while the first control method is performed.

BRIEF DESCRIPTION OF THE DRAWINGS

The figures depict one or more implementations in accordance with the present teaching, by way of example only, not by way of limitations. In the figures, like reference numerals refer to the same or similar elements.

DETAILED DESCRIPTION

The following detail descriptions referring to attached drawings are made to embodiments of lighting control devices according to the present disclosure and embodiments of lighting systems according to the present disclosure. Note that the configurations described in the following embodiments are merely examples of possible embodiments of the present disclosure. Embodiments of the present disclosure may not be limited to the following embodiments, and the following embodiments can be modified in various ways in accordance with design or the like as long as they can achieve technical effects given by the present disclosure.

Figure 1:
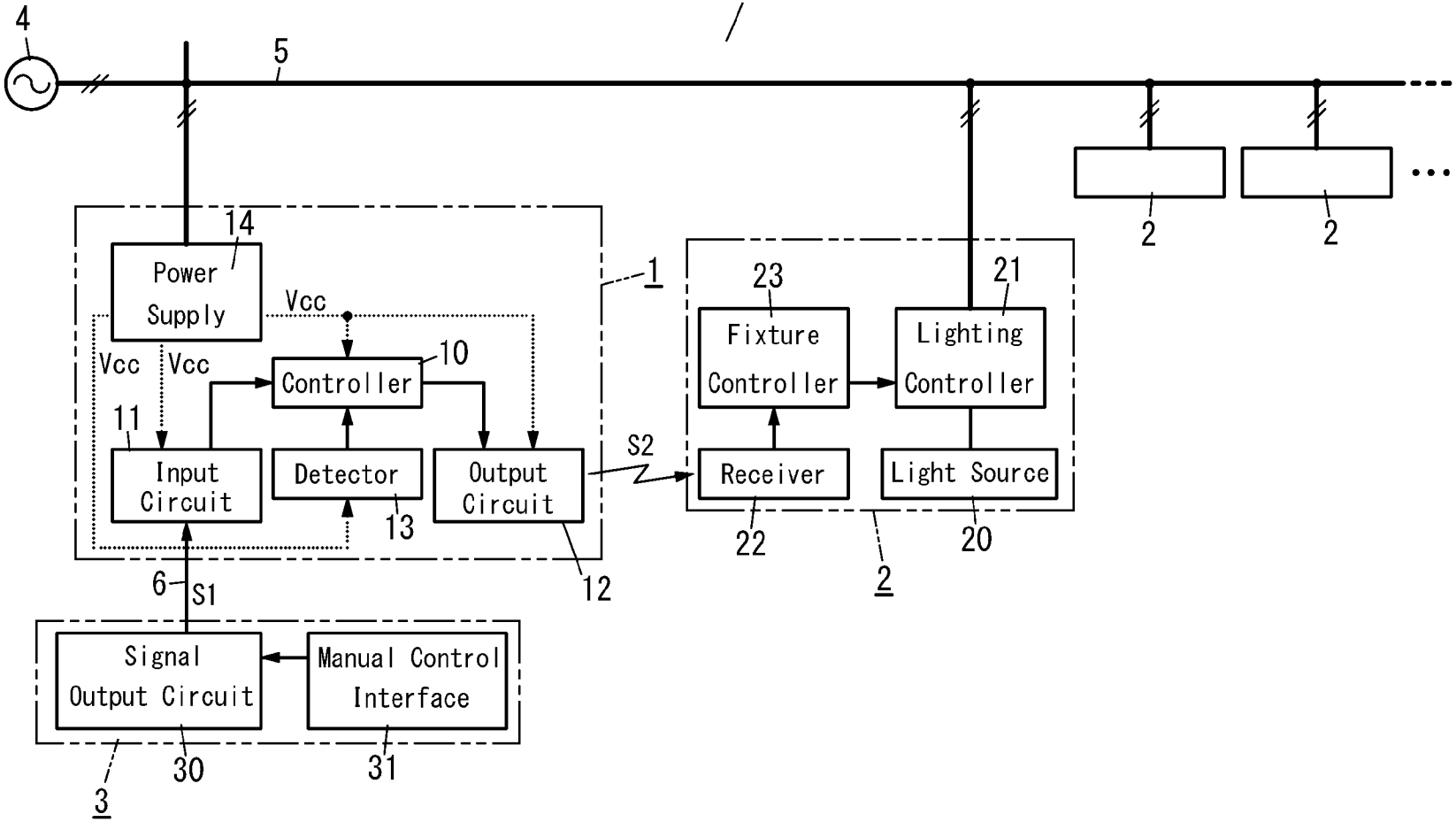
FIG. 1 is a diagram for illustration of system configuration of a lighting system according to one embodiment of the present disclosure and a circuit block of a lighting control device according to one embodiment of the present disclosure.

As shown in FIG. 1, a lighting system 7 of the present embodiment includes a lighting control device 1 and at least one lighting fixture 2. Additionally, the lighting system 7 may preferably include a manual control device 3. The lighting system 7 may include one lighting fixture 2 only, or may include a plurality of lighting fixtures 2. the lighting control device 1 and the at least one lighting fixture 2 are electrically connected to an external power supply 4 through a power supply line 5 which is a two-wire electric cable in a power transferring manner. Examples of the external power supply 4 may include a commercial AC power supply. Note that, the power supply line 5 may be a three-wire electric cable including a grounding line.

All the lighting fixtures 2 have the same configurations. For this reason, FIG. 1 shows a circuit block for only one of the lighting fixtures 2. The lighting fixture 2 includes a light source 20, a lighting controller 21, a receiver 22, and a fixture controller 23. The light source 20 is an LED module including a substrate and a plurality of illumination-use white LEDs (Light Emitting Diodes).

The lighting controller 21 is configured to light (turn on) the light source 20 by converting AC power supplied from the external power supply 4 through the power supply line 5 into DC power and supplying converted DC power to the light source 20. The lighting controller 21 may preferably be constituted by, for example, a full-wave rectifier, a power factor correction circuit (step-up chopper circuit), and a step-down chopper circuit. In accordance with instructions from the fixture controller 23, the lighting controller 21 may turn off the light source 20 by stopping the step-down chopper circuit, and may control brightness of the light source 20 by increasing or decreasing a DC current outputted from the step-down chopper circuit. Note that, the lighting controller 21 operating in such a manner is well-known and therefore detail circuit configuration thereof are not shown and described herein.

The receiver 22 is configured to obtain an original signal (a second dimming signal S2) by demodulating radio waves (wireless signals) received by an antenna, and obtain data (including a duty cycle) included in the thus-obtained second dimming signal S2 and provide the data to the fixture controller 23. Radio waves to be received by the receiver 22 are radio waves (for example radio waves in a 920 MHz band) for specified small power radio stations stipulated in Japanese Radio Act. The receiver 22 operating in such a manner can be realized by a wireless module including one or more integrated circuits, or an RF (Radio Frequency) receiver, and therefore detail circuit configuration thereof are not shown and described herein.

The fixture controller 23 may be preferably realized by one or more microcontrollers. The fixture controller 23 is configured to convert the data (duty cycle) received from the receiver 22 into a dimming level. Note that, the dimming level designates an amount of light from the light source 20 (brightness of the lighting fixture 2). In more detail, the dimming level is defined as a percentage of a desired output current of the lighting controller 21 to an output current of the lighting controller 21 which enables rated lighting of the light source 20. The fixture controller 23 controls the lighting controller 21 so that a current flowing through the lighting controller 21 has magnitude corresponding to the dimming level converted from the duty cycle. For example, when the dimming level is assumed to be 80%, the fixture controller 23 controls the lighting controller 21 so that the current flowing through the lighting controller 21 has magnitude corresponding to 80% of the output current enabling the rated lighting. Accordingly, adjustment (dimming) of light output of the light source 20 is made.

The lighting fixture 2 is a lighting fixture to be mounted on/in a ceiling of a gymnasium or a hall to illuminate a floor of the gymnasium or audience seats of the hall from a height, which is a so-called high-ceiling-mounted lighting fixture. Note that, the lighting fixture 2 may not be limited to such a high-ceiling-mounted lighting fixture but may be a lighting fixture to be mounted on/in a ceiling or a wall of an office or a store.

The lighting control device 1 includes a controller 10, an input circuit 11, an output circuit 12, a detector 13, and a power supply 14 (see FIG. 1). The power supply 14 is electrically connected to the external power supply 4 through the power supply line 5 in a power transferring manner. The power supply 14 converts an AC voltage (for example, an AC voltage with an effective value of 100 V) supplied from the external power supply 4 into a low DC voltage of about 5 V or 3.3 V. The power supply 14 supplies the converted DC voltage as an operation power supply voltage Vcc to the controller 10, the input circuit 11, the output circuit 12, and the detector 13.

The input circuit 11 is electrically connected to the manual control device 3 through a two-wire dimming signal line 6. The input circuit 11 receives a dimming signal (a first dimming signal S1) from the manual control device 3 through the dimming signal line 6. The dimming signal (the first dimming signal S1) is, as shown in FIG. 3D, a rectangular wave signal with a constant period T1 and has a duty cycle corresponding to a dimming level. The duty cycle is, as shown in FIG. 3D, a ratio of an on width T2 to the period T1 of the first dimming signal S1 (given by T2/T1×100 [%]). The input circuit 11 outputs to the controller 10 a DC voltage with a voltage value in proportion to a duty cycle (dimming level) of the first dimming signal S1 by integrating it.

The output circuit 12 sends the second dimming signal S2 through wireless signals using as communication media radio waves (for example radio waves in a 920 MHz band) for specified small power radio stations, in a similar manner to the receiver 22 of the lighting fixture 2. Note that, the output circuit 12 operating in such a manner can be realized by a wireless module including one or more integrated circuits like the receiver 22 of the lighting fixture 2, for example, and therefore detail circuit configuration thereof are not shown and described herein.

The detector 13 may include a photoelectric conversion element such as a photodiode and a solar cell, and an analog-digital conversion circuit for converting an analog electric signal outputted from the photoelectric conversion element into a digital measurement signal. An analog amount of the electric signal outputted from the photoelectric conversion element may be proportional to an amount of light received by the photoelectric conversion element, that is, illuminance.

The controller 10 may be constituted by hardware including one or more microcontrollers, and software executed by the one or more microcontrollers. The software includes a first program and a second program. Note that, in the following description, operation of the controller 10 realized by the one or more microcontrollers executing the first program may be referred to as a first mode, and operation of the controller 10 realized by the one or more microcontrollers executing the second program may be referred to as a second mode.

While operating in the first mode, the controller 10 obtains the measurement signal outputted from the detector 13 and compares the amount of light indicated by the measurement signal with a desired value of brightness. When the amount of light indicated by the measurement signal is lower than the desired value, the controller 10 generates the second dimming signal S2 including data (duty cycle) corresponding to a dimming level higher than the current dimming level, and provides it to the output circuit 12. In contrast, when the amount of light indicated by the measurement signal is higher than the desired value, the controller 10 generates the second dimming signal S2 including data (duty cycle) corresponding to a dimming level lower than the current dimming level, and provides it to the output circuit 12. The second dimming signal S2 provided to the output circuit 12 is outputted (transmitted) to the individual lighting fixtures 2 through wireless signals using radio waves as communication media. In short, while operating in the first mode, the controller 10 controls luminance of the individual lighting fixtures 2 in order to keep constant the brightness (illuminance) of the floor of the gymnasium, the audience seats of the hall, or the like, for example.

While operating in the second mode, the controller 10 generates the second dimming signal S2 with a dimming level equal to a dimming level of the first dimming signal S1 inputted into the input circuit 11, and provides it to the output circuit 12. The second dimming signal S2 provided to the output circuit 12 is outputted (transmitted) to the individual lighting fixtures 2 through wireless signals using radio waves as communication media. In short, while operating in the second mode, the controller 10 relays the first dimming signal S1 received from the manual control device 3 through the dimming signal line 6 to the individual lighting fixtures 2.

The manual control device 3 includes a manual control interface 31 for allowing manual control by hand, and a signal output circuit 30 configured to output the first dimming signal S1 having a duty cycle corresponding to manual control of the manual control interface 31. Additionally, the manual control device 3 may preferably include, as shown in FIG. 3B, a manual controller 32, an output circuit 33, and an indicator 34. The manual control interface 31 may preferably be a push button for allowing push by human hand(s) (finger(s)). For example, the manual controller 32 may preferably include a push button switch configured to: be on while the manual control interface 31 (push button) is pushed; and be off while the manual control interface 31 (push button) is not pushed. The manual controller 32 outputs a manual control signal to the signal output circuit 30 while the push button switch is on. The signal output circuit 30 may be preferably constituted by a microcontroller. When acknowledging reception of the manual control signal from the manual controller 32, the signal output circuit 30 determines that the push button switch (that is the manual control interface 31) is pushed. The indicator 34 includes a plurality of indicating devices, and a drive circuit for operating (lighting) the plurality of indicating devices individually. As to the indicator 34, the drive circuit is controlled by the signal output circuit 30 to light at least one of the plurality of indicating devices. Note that, each indicating device may be preferably an indication-use light emitting diode. The output circuit 33 may be preferably constituted by, as shown in FIG. 3C, a switch device Q1 and a resistor R1. The switch device Q1 is a pnp bipolar transistor. The switch device Q1 has an emitter receiving a constant voltage Vd. The switch device Q1 has a collector electrically connected to the ground via the resistor R1. The switch device Q1 has a base electrically connected to an output port of the microcontroller constituting the signal output circuit 30. A junction between the collector of the switch device Q1 and the resistor R1 is electrically connected to the dimming signal line 6. Accordingly, when the output port of the signal output circuit 30 has a low level, the output circuit 33 turns on the switch device Q1 to cause a flow of current through the resistor R1, thereby allowing the first dimming signal S1 to have a high level. In contrast, when the output port of the signal output circuit 30 has a high level, the output circuit 33 turns off the switch device Q1 not to cause a flow of current through the resistor R1, thereby allowing the first dimming signal S1 to have a low level.

Figure 3A:
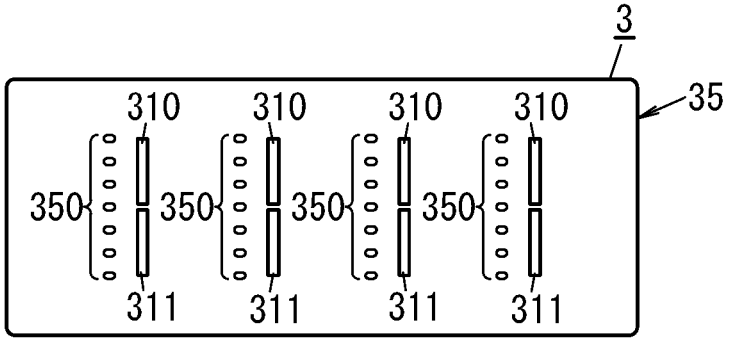
FIG. 3A is a front view of a manual control device in the above lighting system.
Figure 3B:
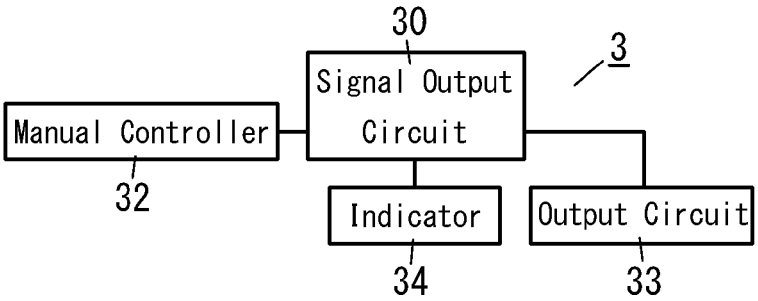
FIG. 3B is a circuit block diagram of the above manual control device.
Figure 3C:
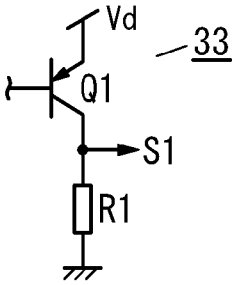
FIG. 3C is a circuit diagram of an output circuit of the above manual control device.
Figure 3D:
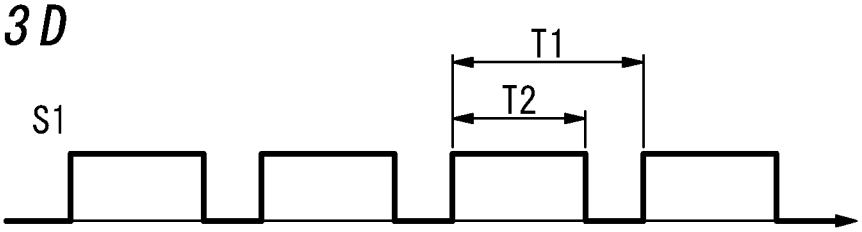
FIG. 3D is a waveform chart of the above first dimming signal.

For example, as shown in FIG. 3A, the manual control device 3 includes a housing 35 which has an elongated rectangular box shape of synthetic resin. The housing 35 has a front face provided with four first push buttons 310 and four second push buttons 311. The four first push buttons 310 are arranged in one line along a lengthwise direction (horizontal direction) of the housing 35. Further, the four second push buttons 311 are arranged in one line along the lengthwise direction (horizontal direction) of the housing 35, and each of the four second push buttons 311 and a corresponding one of the first push button 310 are arranged in one line along a width direction (vertical direction) of the housing 35. The four first push buttons 310 are associated with the four second push buttons 311 one by one. Stated differently, the manual control interface 31 includes four sets of a first push button 310 and a second push button 311 which are arranged in one line along the vertical direction of the housing 35. The signal output circuit 30 is configured to allow electrical connection with dimming signal lines 6 of four systems. The dimming signal line 6 of each system is electrically connected to a corresponding one of the lighting control devices 1. Note that, FIG. 1 shows system configurations where a dimming signal line 6 of only one system is electrically connected to a lighting control device 1. However, in other system configurations, dimming signal lines 6 of four systems may be electrically connected to lighting control devices 1 individually.

In this regard, the front face of the housing 35 is provided with a plurality (for example, seven) of through holes 350 are arranged: in one line along the vertical direction; and in immediate left of a corresponding one of the four sets of the first push button 310 and the second push button 311. These through holes 350 allows light (for example, green light, blue light, or red light) emitted from the plurality of indicating devices of the indicator 34, to pass toward a front side of the housing 35.

The manual controller 32 outputs a first manual control signal while a push button switch corresponding to a first push button 310 is on. The manual controller 32 outputs a second manual control signal while a push button switch corresponding to a second push button 311 is on. The signal output circuit 30 increases the dimming level when receiving the first manual control signal from the manual controller 32. The signal output circuit 30 decreases the dimming level when receiving the second manual control signal from the manual controller 32. Additionally, the signal output circuit 30 controls the indicator 34 to increase or decrease the number of indicating devices to be lit in accordance with the dimming level, thereby allowing the indicator 34 to indicate the dimming level.

Figure 2:
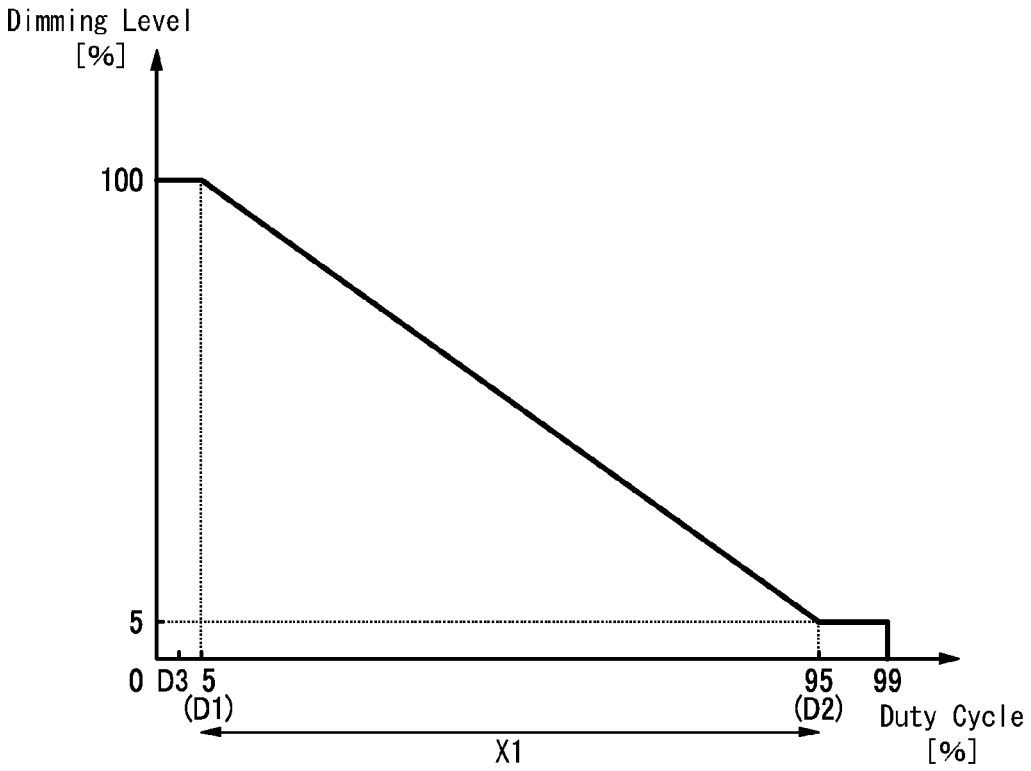
FIG. 2 is a diagram for illustration of a relationship between a duty cycle of a first dimming signal and a dimming level in the lighting control device and the lighting system of the above.

In this regard, the signal output circuit 30 has a function of changing a duty cycle of the first dimming signal S1 within a range X1 from a first duty cycle D1 corresponding to an upper limit of the dimming level to a second duty cycle D2 corresponding to a lower limit of the dimming level (see FIG. 2). Note that, the upper limit of the dimming level is, for example, 100% of a rated value. The lower limit of the dimming level is, for example, 5% of the rated value. Additionally, the first duty cycle D1 is, for example, 5%, and the second duty cycle D2 is, for example, 95% (see FIG. 2). The signal output circuit 30 converts a dimming level designated in response to manual control of the manual control interface 31 into a duty cycle, and outputs a first dimming signal S1 with a converted duty cycle from the output circuit 33 to the lighting control device 1 through the dimming signal line 6 (see FIG. 3D). Note that, the fixture controller 23 of the lighting fixture 2 may preferably control the lighting controller 21 to turn off the light source 20 when a duty cycle of the first dimming signal S1 is a value (for example, 99%) higher than 95%.

Note that, the signal output circuit 30 outputs a first dimming signal S1 having a third duty cycle D3 when a period of time when the manual control interface 31 is pressed continuously is longer than a predetermined period of time (for example, 5 seconds). In more detail, the signal output circuit 30 may preferably output the first dimming signal S1 with its duty cycle being set to the third duty cycle D3, from the output circuit 33, when input of the first manual control signal continues for more than 5 seconds while the dimming level is set to 100%. The third duty cycle D3 may be any of duty cycles not falling within the range X1. For example, the third duty cycle D3 may preferably be equal to or smaller than 2.5%±0.5%.

The controller 10 of the lighting control device 1 is configured to, in response to reception of the first dimming signal S1 with the third duty cycle D3 from the input circuit 11 while operating in the second mode, select the first mode and start operating in the first mode. Additionally, the controller 10 is configured to, in response to reception of the first dimming signal S1 with a third duty cycle within the range X1 while operating in the first mode, select the second mode and start operating in the second mode. In short, the controller 10 is configured to select either the first mode or the second mode and operate in a selected mode in response to a duty cycle (any of duty cycles within the range X1 or the third duty cycle D3) of the first dimming signal S1 inputted into the input circuit 11. Accordingly, by operating by hand the manual control interface 31 of the manual control device 3, a user can change the dimming level and additionally switch the operation mode of (the controller 10 of) the lighting control device 1. Note that, it is preferable that, while outputting the first dimming signal S1 with the third duty cycle D3, the signal output circuit 30 instruct the indicator 34 to indicate that the operation mode of the lighting control device 1 is the first mode. For example, the signal output circuit 30 may control the drive circuit of the indicator 34 to blink an indicating device (an indicating device corresponding to the uppermost through hole 350 in FIG. 3A) which is of indicating devices on opposite ends in the vertical direction and adjacent to the first push button 310. Therefore, by blinking one or more indicating devices of the indicator 34, the manual control device 3 can notify a user that (the controller 10 of) the lighting control device 1 is operating in the first mode.

Figure 4:
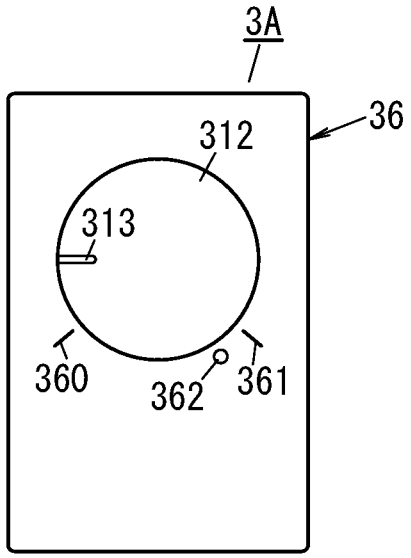
FIG. 4 is a front view of modification 1 of a manual control device in the above lighting system.

Note that, the manual control interface 31 of the manual control device 3 may not be limited to a push button. For example, FIG. 4 shows a manual control device 3A of Modification 1 which includes a housing 36 with a cuboidal shape and a manual control interface (a manual control knob 312) rotatably attached to a front face of the housing 36. The manual control knob 312 is constituted by a molded product of synthetic resin with a hollow cylindrical shape. The manual control knob 312 has a front face (bottom) provided with a straight marking 313. In contrast, in a surrounding of the manual control knob 312 in the front face of the housing 36, a first mark 360, a second mark 361, and a third mark 362 are provided. When viewed from front of the housing 36, the manual control knob 312 is rotatable continuously and bidirectionally between a position (lower limit position) where the marking 313 is aligned with the first mark 360 and another position (upper limit position) where the marking 313 is aligned with the second mark 361. Further, the manual control knob 312 is rotatable bidirectionally between the upper limit position and a position (switching position) where the marking 313 is aligned with the third mark 362.

A manual controller 32 in the manual control device 3A of Modification 1 may preferably include a variable resistor which varies its resistance depending on a manual control position (a position of the marking 313 relative to the housing 36) of the manual control knob 312. The manual controller 32 may be preferably configured to output a manual control signal having voltage in proportion to a current resistance of the variable resistor to a signal output circuit 30. The signal output circuit 30 is configured to, when receiving the manual control signal corresponding to the lower limit position of the manual control knob 312 from the manual controller 32, output the first dimming signal S1 with the second duty cycle D2 corresponding to the lower limit of the dimming level. And, the signal output circuit 30 is configured to, when receiving the manual control signal corresponding to the upper limit position of the manual control knob 312 from the manual controller 32, output the first dimming signal S1 with the first duty cycle D1 corresponding to the upper limit of the dimming level. Additionally, the signal output circuit 30 is configured to, when receiving the manual control signal corresponding to the switching position of the manual control knob 312 from the manual controller 32, output the first dimming signal S1 with the third duty cycle D3. Accordingly, by operating (rotating) the manual control knob 312 of the manual control device 3, a user can change the dimming level and additionally switch the operation mode of (the controller 10 of) the lighting control device 1. Note that, the housing 36 of the manual control device 3 may be preferably designed to give click feeling to a hand of a user manually controlling the manual control knob 312 when the manual control knob 312 is moved (rotated) between the upper limit position and the switching position. For example, as to the manual control device 3, both the manual control knob 312 and the housing 36 may be provided with protrusions so that click feeling is made when a protrusion provided to the manual control knob 312 goes across a protrusion provided to the housing 36.

Note that, the output circuit 12 of the lighting control device 1 may be configured to output the second dimming signal S2 using an electromagnetic wave other than a radio wave, that is, infrared light, as a communication medium. Alternatively, the output circuit 12 may be configured to output the second dimming signal S2 using an electric conductor (an electric conductor of a clad cable) instead of an electromagnetic wave. The manual control interface 31 of the manual control device 3 may be a slidable manual control knob instead of a push button or the rotary manual control knob 312.

As apparently derived from the above descriptions, the lighting control device (1) of the first aspect includes: an input circuit (11) configured to receive from outside a first dimming signal (S1) having a duty cycle corresponding to a dimming level designating brightness of a lighting fixture (2); and an output circuit (12) configured to output a second dimming signal (S2) to the lighting fixture (2). The lighting control device (1) further includes: a detector (13) configured to measure brightness of surroundings; and a controller (10) configured to select one operation mode from two operation modes including a first mode and a second mode, and operate in a selected operation mode. The first dimming signal (S1) has a duty cycle falling within a range (X1) from a first duty cycle (D1) corresponding to an upper limit of the dimming level of the lighting fixture (2) to a second duty cycle (D2) corresponding to a lower limit of the dimming level of the lighting fixture (2). The controller (10) is configured to, while operating in the first mode, generate a second dimming signal (S2) corresponding to a measurement result of the detector (13). The controller (10) is configured to, while operating in the second mode, generate a second dimming signal (S2) corresponding to the first dimming signal (S1). The controller (10) is configured to select the first mode and start operating in the first mode when the input circuit (11) receives the first dimming signal (S1) having a third duty cycle (D3) not falling within the range (X1) while operating in the second mode. The controller (10) is configured to select the second mode and start operating in the second mode when the input circuit (11) receives the first dimming signal (S1) having a duty cycle falling within the range (X1) while operating in the first mode.

The lighting control device (1) of the first aspect enables dimming control according to brightness of surroundings measured by the detector (13), and additionally dimming control according to the first dimming signal (S1) inputted into the input circuit (11) from an external device. Therefore, the lighting control device (1) of the first aspect can increase types of dimming control and improve usability.

The lighting control device (1) of the second aspect would be realized in combination with the first aspect. In the lighting control device (1) of the second aspect, the detector (13) is configured to measure brightness of a space to be illuminated by the lighting fixture (2) and output a measurement signal indicative of a measurement value of the brightness of the space to the controller (10). The controller (10) is configured to, while operating in the first mode, determine a dimming level enabling decreasing a difference between the measurement value indicated by the measurement signal and a desired value for the brightness of the space, and generate the second dimming signal (S2) including a duty cycle corresponding to the dimming level determined.

The lighting control device (1) of the second aspect can control the brightness of the space to be illuminated by the lighting fixture (2) to correspond to the desired value.

The lighting control device (1) of the third aspect would be realized in combination with the first or second aspect. In the lighting control device (1) of the third aspect, the controller (10) is configured to, while operating in the second mode, generate the second dimming signal (S2) including a duty cycle corresponding to a dimming level equal to a dimming level indicated by the first dimming signal (S1) received by the input circuit (11).

The lighting control device (1) of the third aspect can control the brightness of the space to be illuminated by the lighting fixture (2) to correspond to desired brightness.

The lighting control device (1) of the fourth aspect would be realized in combination with any one of the first to third aspects. In the lighting control device (1) of the fourth aspect, the output circuit (12) is configured to output the second dimming signal (S2) using an electromagnetic wave as a communication medium. Note that, the electromagnetic wave may be a radio wave or another electromagnetic wave, such as the infrared light, other than a radio wave.

The lighting control device (1) of the fourth aspect can omit electric cables for electrically interconnecting the output circuit (12) and the lighting fixture (2) to allow transmission of the second dimming signal (S2), and accordingly, installation can be simplified.

The lighting control device (1) of the fifth aspect would be realized in combination with any one of the first to third aspects. In the lighting control device (1) of the fifth aspect, the output circuit (12) is configured to output the second dimming signal (S2) using an electric conductor as a communication medium.

The lighting control device (1) of the fifth aspect can reduce influence of possible noises received on the second dimming signal (S2).

As apparently derived from the above descriptions, the lighting system (7) of the sixth aspect includes: the lighting control device (1) according to any one of the first to fifth aspects; and a manual control device (3; 3A) configured to output the first dimming signal (S1) having a duty cycle corresponding to the dimming level to the input circuit (11) of the lighting control device (1). The manual control device (3; 3A) includes: a manual control interface (31) for allowing manual control by hand; and a signal output circuit (30) configured to output the first dimming signal (S1) having a duty cycle corresponding to manual control of the manual control interface (31).

The lighting system (7) of the sixth aspect allows output of the first dimming signal (S1) to the lighting control device (1) from the manual control device (3; 3A) including the manual control interface (31) to be manually operated by hand. Therefore, usability can be improved.

The lighting system (7) of the seventh aspect would be realized in combination with the sixth aspect. In the lighting system (7) of the seventh aspect, the manual control interface (31) is a push button (the first push button 310; the second push button 311). The signal output circuit (30) is configured to output the first dimming signal (S1) having a duty cycle falling within the range (X1) from the first duty cycle (D1) to the second duty cycle (D2) each time the manual control interface (31) is pushed. And, the signal output circuit (30) is configured to output the first dimming signal (S1) having the third duty cycle (D3) when a period of time when the manual control interface (31) is pressed continuously is longer than a predetermined period of time.

According to the lighting system (7) of the seventh aspect, there is no need to provide a dedicated manual control interface to the manual control device (3) in order to allow the manual control device (3) to output the first dimming signal (S1) with the third duty cycle (D3). Therefore, configurations of the manual control device (3) can be simplified.

The lighting system (7) of the eighth aspect would be realized in combination with the sixth aspect. In the lighting system (7) of the eighth aspect, the manual control interface includes a manual control knob (312) to be rotated or slid. The signal output circuit (30) is configured to output the first dimming signal (S1) having a duty cycle falling within the range (X1) from the first duty cycle (D1) to the second duty cycle (D2) in accordance with a manual control position of the manual control knob (312) rotated or slid. And, the signal output circuit (30) is configured to output the first dimming signal (S1) having the third duty cycle (D3) when the manual control knob (312) reaches a predetermined position by being rotated or slid.

According to the lighting system (7) of the eighth aspect, there is no need to provide a dedicated manual control interface to the manual control device (3A) in order to allow the manual control device (3A) to output the first dimming signal (S1) with the third duty cycle (D3). Therefore, configurations of the manual control device (3A) can be simplified.

The lighting system (7) of the ninth aspect would be realized in combination with any one of the sixth to eighth aspects. In the lighting system (7) of the ninth aspect, the manual control device (3) further includes an indicator (34). The indicator (34) is configured to make indication while the signal output circuit (30) is outputting the first dimming signal (S1) having the third duty cycle (D3).

The lighting system (7) of the ninth aspect can inform a user by indication of the indicator (34), that the controller (10) of the lighting control device (1) is in operation in the first mode.

As apparently derived from the above descriptions, the lighting system (7) of the tenth aspect includes: the lighting control device (1) according to any one of the first to fifth aspects; and at least one lighting fixture (2). The at least one lighting fixture (2) is configured to, when receiving the second dimming signal (S2) outputted from the output circuit (12) of the lighting control device (1), allow light output thereof to correspond to a dimming level indicated by the second dimming signal (S2) received.

The lighting system (7) of the tenth aspect enables dimming control according to brightness of surroundings measured by the detector (13), and additionally dimming control according to the first dimming signal (S1) inputted into the input circuit (11) from an external device. Therefore, the lighting system (7) of the tenth aspect can increase types of dimming control and improve usability.

The lighting system (7) of the eleventh aspect would be realized in combination with the tenth aspect. The lighting system (7) of the eleventh aspect includes a manual control device (3; 3A) configured to output the first dimming signal (S1) to the lighting control device (1). The manual control device (3; 3A) includes: a manual control interface (31) for allowing manual control by hand, and a signal output circuit (30) configured to output the first dimming signal (S1) having a duty cycle corresponding to manual control of the manual control interface (31).

The lighting system (7) of the eleventh aspect allows output of the first dimming signal (S1) to the lighting control device (1) from the manual control device (3; 3A) including the manual control interface (31) to be manually operated by hand. Therefore, usability can be improved.

The lighting system (7) of the twelfth aspect would be realized in combination with the eleventh aspect. In the lighting system (7) of the twelfth aspect, the manual control interface (31) is a push button (the first push button 310; the second push button 311). The signal output circuit (30) is configured to output the first dimming signal (S1) having a duty cycle falling within the range (X1) from the first duty cycle (D1) to the second duty cycle (D2) each time the manual control interface (31) is pushed. And, the signal output circuit (30) is configured to output the first dimming signal (S1) having the third duty cycle (D3) when a period of time when the manual control interface (31) is pressed continuously is longer than a predetermined period of time.

According to the lighting system (7) of the twelfth aspect, there is no need to provide a dedicated manual control interface to the manual control device (3) in order to allow the manual control device (3) to output the first dimming signal (S1) with the third duty cycle (D3). Therefore, configurations of the manual control device (3) can be simplified.

The lighting system (7) of the thirteenth aspect would be realized in combination with the eleventh aspect. In the lighting system (7) of the thirteenth aspect, the manual control interface includes a manual control knob (312) to be rotated or slid. The signal output circuit (30) is configured to output the first dimming signal (S1) having a duty cycle falling within the range (X1) from the first duty cycle (D1) to the second duty cycle (D2) in accordance with a manual control position of the manual control knob (312) rotated or slid. And, the signal output circuit (30) is configured to output the first dimming signal (S1) having the third duty cycle (D3) when the manual control knob (312) reaches a predetermined position by being rotated or slid.

According to the lighting system (7) of the thirteenth aspect, there is no need to provide a dedicated manual control interface to the manual control device (3A) in order to allow the manual control device (3A) to output the first dimming signal (S1) with the third duty cycle (D3). Therefore, configurations of the manual control device (3A) can be simplified.

The lighting system (7) of the fourteenth aspect would be realized in combination with any one of the eleventh to thirteenth aspects. In the lighting system (7) of the fourteenth aspect, the manual control device (3) further includes an indicator (34). The indicator (34) is configured to make indication while the signal output circuit (30) is outputting the first dimming signal (S1) having the third duty cycle (D3).

The lighting system (7) of the fourteenth aspect can inform a user by indication of the indicator (34), that the controller (10) of the lighting control device (1) is in operation in the first mode.

The lighting control method of the fifteenth aspect includes: selecting one control method from two control methods including a first control method and a second control method; and performing a selected control method to achieve dimming control of at least one lighting fixture (2). The first control method is a control method of generating a second dimming signal (S2) corresponding to a measurement result of brightness of surroundings. The second control method is a control method of generating a second dimming signal (S2) corresponding to a first dimming signal (S1) having a duty cycle corresponding to a dimming level designating brightness of the at least one lighting fixture (2). The first control method is selected and performed when the first dimming signal (S1) having a third duty cycle (D3) not falling within a range (X1) from a first duty cycle (D1) corresponding to an upper limit of the dimming level to a second duty cycle (D2) corresponding to a lower limit of the dimming level is inputted while the second control method is performed. The second control method is selected and performed when the first dimming signal (S1) having a duty cycle falling within the range (X1) is inputted while the first control method is performed.

The lighting control method of the fifteenth aspect enables dimming control according to brightness of surroundings, and additionally dimming control according to the first dimming signal (S1) inputted from an external device. Therefore, it is possible to increase types of dimming control and improve usability.

While the foregoing has described what are considered to be the best mode and/or other examples, it is understood that various modifications may be made therein and that the subject matter disclosed herein may be implemented in various forms and examples, and that they may be applied in numerous applications, only some of which have been described herein. It is intended by the following claims to claim any and all modifications and variations that fall within the true scope of the present teachings.

The invention claimed is:

1. A lighting control device comprising:

an input circuit configured to receive from outside a first dimming signal having a duty cycle corresponding to a dimming level designating brightness of a lighting fixture;

an output circuit configured to output a second dimming signal to the lighting fixture;

a detector configured to measure brightness of surroundings; and a controller configured to select one operation mode from two operation modes including a first mode and a second mode, and operate in a selected operation mode, wherein:

the first dimming signal has a duty cycle falling within a range from a first duty cycle corresponding to an upper limit of the dimming level of the lighting fixture to a second duty cycle corresponding to a lower limit of the dimming level of the lighting fixture;

the controller is configured to, while operating in the first mode, generate a second dimming signal corresponding to a measurement result of the detector;

the controller is configured to, while operating in the second mode, generate a second dimming signal corresponding to the first dimming signal;

the controller is configured to select the first mode and start operating in the first mode when the input circuit receives the first dimming signal having a third duty cycle not falling within the range while operating in the second mode; and the controller is configured to select the second mode and start operating in the second mode when the input circuit receives the first dimming signal having a duty cycle falling within the range while operating in the first mode.

2. The lighting control device according to claim 1, wherein:

the detector is configured to measure brightness of a space to be illuminated by the lighting fixture and output a measurement signal indicative of a measurement value of the brightness of the space to the controller; and the controller is configured to, while operating in the first mode, determine a dimming level enabling decreasing a difference between the measurement value indicated by the measurement signal and a desired value for the brightness of the space, and generate the second dimming signal including a duty cycle corresponding to the dimming level determined.

3. The lighting control device according to claim 1, wherein the controller is configured to, while operating in the second mode, generate the second dimming signal including a duty cycle corresponding to a dimming level equal to a dimming level indicated by the first dimming signal received by the input circuit.

4. The lighting control device according to claim 1, wherein the output circuit is configured to output the second dimming signal using an electromagnetic wave as a communication medium.

5. The lighting control device according to claim 1, wherein the output circuit is configured to output the second dimming signal using an electric conductor as a communication medium.

6. A lighting system comprising:

the lighting control device according to claim 1; and a manual control device configured to output the first dimming signal having a duty cycle corresponding to the dimming level to the input circuit of the lighting control device, wherein the manual control device includes a manual control interface for allowing manual control by hand, and a signal output circuit configured to output the first dimming signal having a duty cycle corresponding to manual control of the manual control interface.

7. The lighting system according to claim 6, wherein:

the manual control interface is a push button and the signal output circuit is configured to output the first dimming signal having a duty cycle falling within the range from the first duty cycle to the second duty cycle each time the manual control interface is pushed, and output the first dimming signal having the third duty cycle when a period of time when the manual control interface is pressed continuously is longer than a predetermined period of time.

8. The lighting system according to claim 6, wherein:

the manual control interface includes a manual control knob to be rotated or slid; and the signal output circuit is configured to output the first dimming signal having a duty cycle falling within the range from the first duty cycle to the second duty cycle in accordance with a manual control position of the manual control knob rotated or slid, and output the first dimming signal having the third duty cycle when the manual control knob reaches a predetermined position by being rotated or slid.

9. The lighting system according to claim 6, wherein:

the manual control device further includes an indicator; and the indicator is configured to make indication while the signal output circuit is outputting the first dimming signal having the third duty cycle.

10. A lighting system comprising:

the lighting control device according to claim 1; and at least one lighting fixture, wherein the at least one lighting fixture is configured to, when receiving the second dimming signal outputted from the output circuit of the lighting control device, allow light output thereof to correspond to a dimming level indicated by the second dimming signal received.

11. The lighting system according to claim 10, further comprising a manual control device configured to output the first dimming signal to the lighting control device, wherein the manual control device includes a manual control interface for allowing manual control by hand, and a signal output circuit configured to output the first dimming signal having a duty cycle corresponding to manual control of the manual control interface.

12. The lighting system according to claim 11, wherein:

the manual control interface is a push button; and the signal output circuit is configured to output the first dimming signal having a duty cycle falling within the range from the first duty cycle to the second duty cycle each time the manual control interface is pushed, and output the first dimming signal having the third duty cycle when a period of time when the manual control interface is pressed continuously is longer than a predetermined period of time.

13. The lighting system according to claim 11, wherein:

the manual control interface includes a manual control knob to be rotated or slid; and the signal output circuit is configured to output the first dimming signal having a duty cycle falling within the range from the first duty cycle to the second duty cycle in accordance with a manual control position of the manual control knob rotated or slid, and output the first dimming signal having the third duty cycle when the manual control knob reaches a predetermined position by being rotated or slid.

14. The lighting system according to claim 11, wherein:

the manual control device further includes an indicator; and the indicator is configured to make indication while the signal output circuit is outputting the first dimming signal having the third duty cycle.

15. A lighting control method comprising:

selecting one control method from two control methods including a first control method and a second control method; and performing a selected control method to achieve dimming control of at least one lighting fixture, wherein:

the first control method is a control method of generating a second dimming signal corresponding to a measurement result of brightness of surroundings;

the second control method is a control method of generating a second dimming signal corresponding to a first dimming signal having a duty cycle corresponding to a dimming level designating brightness of the at least one lighting fixture;

the first control method is selected and performed when the first dimming signal having a third duty cycle not falling within a range from a first duty cycle corresponding to an upper limit of the dimming level to a second duty cycle corresponding to a lower limit of the dimming level is inputted while the second control method is performed; and the second control method is selected and performed when the first dimming signal having a duty cycle falling within the range is inputted while the first control method is performed.

* * * * *